US007735824B2

(12) United States Patent
Frank et al.

(10) Patent No.: US 7,735,824 B2
(45) Date of Patent: Jun. 15, 2010

(54) BACK-EDGE BRAKING SYSTEM

(75) Inventors: Hendrik Frank, Heidelberg (DE); Michael Pasuch, Walldorf (DE); Peter Palmen, Mönchengladbach (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 237 days.

(21) Appl. No.: 11/779,497

(22) Filed: Jul. 18, 2007

(65) Prior Publication Data

US 2008/0169601 A1 Jul. 17, 2008

(30) Foreign Application Priority Data

Jul. 26, 2006 (DE) ..... 10 2006 034 509
Jul. 26, 2006 (DE) ..... 10 2006 034 511
May 11, 2007 (DE) ..... 10 2007 022 725

(51) Int. Cl.
*B65H 29/68* (2006.01)

(52) U.S. Cl. ..... 271/182; 271/204

(58) Field of Classification Search ..... 271/162, 271/183, 204, 182
See application file for complete search history.

(56) References Cited

U.S. PATENT DOCUMENTS 2,829,890 A 4/1958 Kury et al.
4,175,477 A * 11/1979 Inose et al. ..... 493/362
4,485,708 A 12/1984 Halff et al.
4,763,551 A 8/1988 Halff et al.
4,903,560 A 2/1990 Halff et al.
5,060,928 A * 10/1991 Vits ..... 271/182
5,431,386 A * 7/1995 Blaser ..... 271/204
5,599,012 A 2/1997 Rebeaud
6,691,999 B2 2/2004 Gunshera et al.
7,210,679 B2 * 5/2007 Schafer et al. ..... 271/183
7,225,731 B2 6/2007 Bayer et al.
2004/0149097 A1 8/2004 Bayer et al.
2005/0067761 A1 * 3/2005 Schafer et al. ..... 271/183

FOREIGN PATENT DOCUMENTS

DE 3044083 A1 9/1982
DE 42 18 421 A1 12/1993
DE 695 00 514 T2 1/1998
DE 102 59 556 A1 7/2004
DE 10 2004 022 235 A1 12/2005

(Continued)

OTHER PUBLICATIONS

Official Communication issued in counterpart European Application No. 07111233.8, mailed on Jun. 4, 2009.

(Continued)

*Primary Examiner*—Patrick Mackey
*Assistant Examiner*—Michael C McCullough
(74) *Attorney, Agent, or Firm*—Keating & Bennett, LLP

(57) ABSTRACT

A sheet processing machine for the processing of sheets of paper, cardboard, and the like, includes at least one processing station, one delivery unit, one sheet transport system including circulating gripper carts, which are driven by individually actuated linear drives, a machine control system and braking devices located in the entry zone of processing stations. The back edge of the respective sheet at its stop position in the delivery unit and/or the at least one processing station lies directly above the back edge of the delivery stack and/or the back edge of a tool or die of the processing station.

7 Claims, 3 Drawing Sheets

FOREIGN PATENT DOCUMENTS

| | | | |
|---|---|---|---|
| EP | 0 681 975 | A1 | 11/1995 |
| EP | 1 108 671 | A2 | 6/2001 |
| EP | 1 431 011 | A1 | 6/2004 |

OTHER PUBLICATIONS

"Post-Processing, Training Manual for Bookbinders", Bundesverband Druck E.V., 1996, p. 262.

Ehrbar, David,; "Sheet Punching and Embossing Machine With Adjustable Punching or Embossing Pressure," U.S. Appl. No. 11/779,495, filed Jul. 18, 2007.

Hendrik Frank; "Sheet Punching and Embossing Machine With Register Orienting and Method for Operating a Sheet Punching and Embossing Machine," U.S. Appl. No. 11/779,501, filed Jul. 18, 2007.

* cited by examiner

BACK-EDGE BRAKING SYSTEM

BACKGROUND OF THE INVENTION

1. Field of the Invention

The present invention relates to a sheet processing machine including a sheet braking device and a method for the braking of sheets to a standstill.

2. Description of the Related Art

Sheet processing machines usually possess an input device, processing stations, and a delivery device. From a stack of sheets located in the input device, a sheet lying face up is singled out and passed off to a transport system. The transport system transports the sheet through the processing stations and to the delivery device. A known transport system has circulating gripper carts, each of which consists of a cross rod on which grippers are mounted which are used to grab the sheet by the front edge and whose ends are secured on a chain drive at the sides which carries the gripper carts through the machine. For the processing and the delivery steps, the sheet must be braked to a standstill. This is done, first, by braking the gripper cart and also, in addition, by additional sheet brakes. The sheet processing machines can be, for example, sheet printing machines or, in particular, sheet punching and embossing machines.

Punching refers to a cutting with closed, geometrical forms, which can be circular, oval, or polygonal, as well as special shapes of every kind. Practices in the post-processing of a print job, such as punching with a hollow punch, rounding corners, and register punching are also included in this field. The punching is done against a base or against a punch, and sometimes there are also shearing processes (cf. Post-processing, Training Manual for Bookbinders, Bundesverband Druck e.V. 1996, page 351 et seq.) involved. Packaging materials of paper, cardboard, paperboard or corrugated cardboard are primarily punched in sheet format. During the punching process, however, groove lines or blind imprints may also be introduced into the finished sheets. This complex process makes it essential to punch the sheets individually. Since the end products are packages with demanding technical and graphical requirements (such as those for cosmetics, cigarettes, medicines, foods, etc.), special requirements are placed not only on the packaging materials themselves, but also one needs punching dies with minimal tolerances and extremely precise and reliable punching machines for optimal results. These demands are best met by flat bed punches. The printed sheets, stacked on a pallet, are fed to the punch. In the machine, the sheets being punched are first oriented accurately in an orienting mechanism, picked up by a gripping cart and positioned exactly in the punching mechanism between a firmly mounted bottom table and a top table, able to move vertically via a bent lever or eccentric gearing.

Such a flat bed punch is known, for example, from DE 30 44 083 A1. The two tables are provided with cutting and grooving dies and corresponding counterplates, with which the finished copies are punched out from the sheets carried between the table surfaces in a timed cycle, and at the same time, the grooves needed for making a clean fold are indented. In the subsequent breakaway mechanism, the waste is mechanically removed via breakaway dies. Finally, depending on the machine construction, the punched copies can be separated in a copy separation mechanism.

Both in the breakaway station and in the copy separation station with sheet delivery, the sheet must be braked from the transport speed down to a standstill. Since the sheet, weakened by the preceding cut, enters the station at high speed, mere slowing down of the front gripper rod can cause a pushing up of its rear part, or so-called "bulging" of the sheet. This should be prevented by additional braking devices, which act on the surface of the sheet. The taut sheet can then be processed with greater precision or laid aside with edge aligned.

Various types of sheet braking devices are known in the prior art.

EP 1 108 671 A2 shows a sheet braking system for a delivery unit of a sheet processing machine with a circulating brake band. The brake band has a suction region, which exerts a suction action on a sheet being braked. The brake band periodically runs through deceleration and acceleration phases, i.e., it is moved in time with the sheet transport. During the course of a deceleration phase of a sheet, the braking section of the band is covered by the sheet being braked.

DE 42 18 421 A1 shows the sheet guide in the delivery unit of a sheet printing machine. Two gripping systems are used here and include a front-edge gripping system and a back-edge gripping system, each of which has sheet grippers for grasping the edges of the sheet. The simultaneous guiding of a sheet at its front and its rear edge makes it possible to transport and brake the sheet safely and free of damage.

In an alternative solution, pneumatic sheet brakes are used, as is known from DE 102 59 556 A1. These sheet brakes are situated in direct proximity to the sheet and provide a partial vacuum, which acts as a braking force on the sheet moving past the pneumatic sheet brake. Pneumatic sheet brakes have the advantage over mechanical sheet brakes that the surface of the sheet is not impaired, and thus one can avoid leaving marks on the sheet. The mode of operation of pneumatic sheet brakes is based on the Venturi effect.

DE 695 00 514 T2 shows, for example, a sheet braking device with brushes. The braking brushes are slanted relative to the direction of sheet transport and exert by light pressure a braking force on the sheet. The drawback is that this may leave marks on the sheet.

DE 10 2004 022 235 A1 discloses a device for delivery of sheets in a sheet delivery unit of a sheet printing machine. The device is based on both a sheet brake using friction to act on the entire width of the sheet, and a removal gripper and suction bar, which are located in the rear area of the delivery unit. Since the sheets, for an optimal placement, are to be grabbed and then released at different moments of time, depending on the operating mode or material properties, the suction bar is arranged such that it can move in the sheet transport direction. The problem with this design of a sheet brake is that the suction bar, being movable, is subject to more intense wear and tear. Furthermore, such a sheet brake cannot be used in the processing stations of a sheet processing machine, or else there will be a collision between processing dies and suction bar. But it is necessary to adapt the sheet brake to the sheet format in order to make sure that the sheet brake acts on the sheet until shortly before it reaches standstill.

What is common to all sheet braking systems known in the prior art is that they are located in the entry zone of the processing stations and delivery unit and thus are arranged directly in front of the delivery surface or processing dies. In practice, however, the lengths of delivery unit and processing stations do not always correspond to the sheet lengths being currently used. Thus, subformat sheets cannot be braked to a standstill by the sheet braking system, since the sheets are transported by the front edge to a defined end position and therefore are no longer situated in the active zone of the sheet braking system. In order to brake the sheets nonetheless to a standstill, they generally need to be braked strongly by the front edge.

SUMMARY OF THE INVENTION

In order to overcome the problems described above, preferred embodiments of the present invention provide a sheet processing machine in which sheets are halted in a precise and gentle manner, regardless of their format, with a defined position of the rear edge of the sheet.

In one preferred embodiment of the present invention, a sheet processing machine for the processing of sheets of paper, cardboard, and the like, includes at least one processing station, one delivery unit, and one sheet transport system including circulating gripper carts. If the sheet processing machine is a sheet punching and embossing machine, the processing stations can be configured as a punching station, a breakaway station, and a finished copy separating station. The gripper carts are driven by individually actuated linear drives. The processing stations and the sheet transport system are actuated by a common machine control system. The sheets are transported by the sheet transport system from the sheet feeder, from the rear end of the machine, through the individual processing stations in the sheet transport direction as far as the delivery unit, at the front end of the machine.

A braking device is located between the entry edge of the delivery unit and the rear edge of the delivery stack. The entry edge of the delivery unit is one of the station boundaries of the delivery unit, namely, the edge of the delivery unit which a moving sheet passes first. The rear edge of the delivery stack is formed by the rear edges of sheets already stacked up. Furthermore, one braking device can be located between the entry edge of a processing station and the rear edge of a processing station tool or die. The entry edge of the processing station is one of the station boundaries of the processing station, namely, the edge of the processing station which a moving sheet passes first. The rear edge of the tool or die of the processing station is the edge of the tool or die which a moving sheet passes first. The sheet is braked from its transport speed to a standstill for processing in one of the processing stations and for output in the delivery unit. The sheet is then processed in its stop position or it is set aside. The stop position of a sheet can be described by the position of the gripper cart during the standstill of the sheet.

A sheet in its stop position in the delivery unit and/or its stop position in the at least one processing station is oriented with respect to its back edge. This is done by transporting the respective sheet by the linear-driven gripper cart of the sheet transport system up to a format-dependent stop position and having the braking device act on the respective sheet until it comes to a standstill. This prevents a "bulging" of the sheet. Thanks to this orienting in the sheet processing machine of a preferred embodiment of the present invention, the back edge of the respective sheet and the back edge of the delivery stack or the back edge of the tool or die of a processing machine will advantageously lie one on top of the other.

The sheet braking device can be configured in various alternative preferred embodiments, such as a sheet brake synchronized with a circulating suction band, as a back-edge gripper system with a circulating after-grippers to grab the back edge of the sheet, as a pneumatic sheet brake with an immobile suction mechanism, as a device with braking brushes or as a non-synchronized sheet brake with a permanently circulating suction band.

Another preferred embodiment of the invention provides a method of braking of sheets to a standstill in a sheet processing machine, especially subformat sheets. The phrase subformat sheets refers to sheets that do not have the maximum sheet length permitted by the dimensions of the processing stations. In a first step of the method, the sheet format is determined by the machine operator. In a second step, the operator enters the sheet format in the machine controls. These two steps can also be combined by automation. In that case, the sheet format is determined via sensors and reported to the machine controls. In a third step, the machine controls calculate the sheet stop positions for each sheet in the delivery unit or the processing stations such that the back edge of a respective sheet and the back edge of the delivery stack or the back edge of the tool or die of a processing station lie one on top of the other. That is, the sheet is oriented at its back edge. In a fourth step, the machine can be placed in operation, wherein the linear drives of the sheet transport system of the sheet processing machine and the sheet braking devices located immediately in front of the processing stations or the delivery unit are actuated by the machine controls such that the sheet is braked each time exactly in its sheet stop position.

The method can be monitored by sensors which are familiar to the practitioner, and the monitoring result can be reported back to the machine controls.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
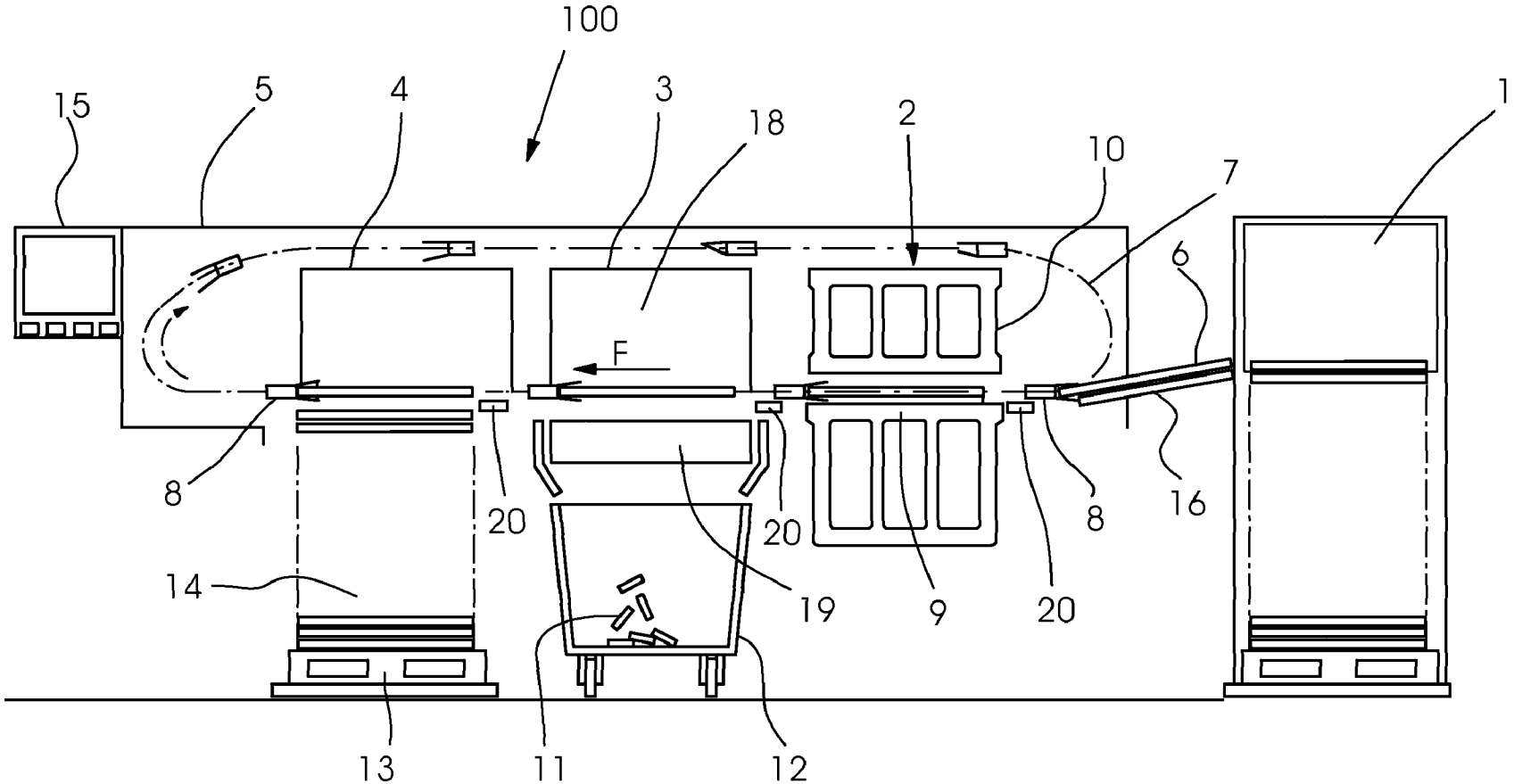
FIG. 1 illustrates a sheet processing machine according to a preferred embodiment of the present invention.

FIG. 1 shows the basic layout of a sheet punching and embossing machine 100 for the punching, breaking away, and stacking of sheets of paper, cardboard, and the like. The punching and embossing machine 100 has a sheet feeder 1, a punching station 2, a breakaway station 3 and a delivery unit 4, which are supported and enclosed by a common machine housing 5.

The sheets 6 are singled out from a stack and fed by a sheet feeder 1 and a sheet feed table 16, and grabbed at their front edge by gripper carts 8 with grippers, secured to circulating chains 7, and pulled through the various stations 2, 3 and 4 of the punching and embossing machine 100.

The punching station 2 preferably includes a lower table 9 and an upper table 10. The lower table 9 is fixedly mounted in the machine frame and provided with a counterplate for the punching blade. The upper table 10 is mounted such that it can move back and forth vertically. In the entry zone of the punching station 2 there is a sheet braking device 20, such as a synchronized sheet brake including a circulating suction band. The phrase entry zone of the punching station refers to the region between the entry edge of the station and the back edge of the punching die.

The gripper carts 8 transport the sheet 6 from the punching and embossing station 2 to the following breakaway station 3, which is outfitted with breakaway dies. In the breakaway station 3, the unneeded scraps are pushed off downward from the sheet 6 by the breakaway dies, so that the scraps 11 drop into a cart 12 underneath the station. In the entry zone of the breakaway station 3 there is a sheet braking device 20. The phrase entry zone of the breakaway station refers to the region between the entry edge of the station and the back edge of the breakaway die.

From the breakaway station 3, the sheet moves to the delivery unit 4, where the sheet is either just piled up or separated into individual copies at the same time. A sheet braking device 20 is located in the entry zone of the delivery unit 4. The delivery unit 4 can also contain a pallet 13 on which the individual sheets are stacked in the form of a pile 14, so that after reaching a certain pile height, the pallets with the stacked sheets 14 can be driven out from the area of the punching and embossing machine 100. The above-described operations are controlled by the machine control system 15.

Figure 2A:
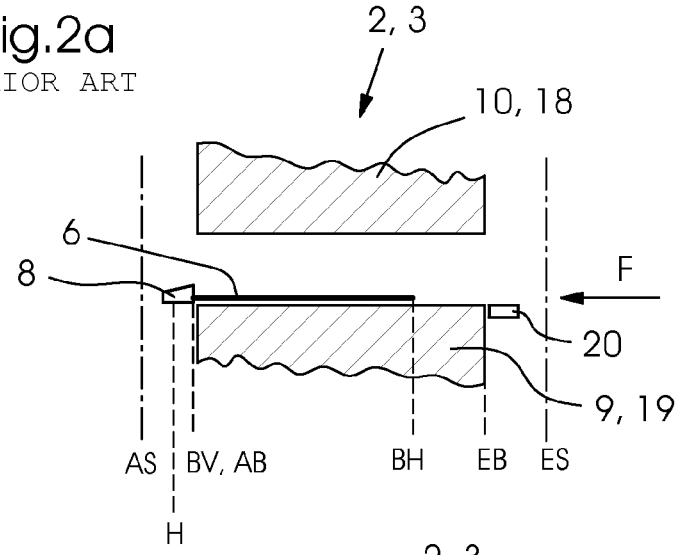
Fig.2a PRIOR ART
FIG. 2*a* illustrates a processing station showing a position of a sheet and a braking device of the prior art.

FIG. 2*a* shows a sheet 6 in its stop position H in a processing station 2, 3 according to the prior art, where ES is an entry edge of the station and AS is the exit edge of the station. A sheet 6 grasped by grippers of a gripper cart 8 with linear drive 40 is introduced into the processing station 2, 3 in the sheet transport direction F. As soon as the front edge BV of the sheet reaches the braking device 20, this acts on a sheet 6 until the rear edge BH of the sheet also passes the braking device 20. For the processing of the sheet 6 between lower table 9 and upper table 10 or upper die 18 and lower die 19, the sheet 6 is oriented exactly by its front edge BV in the prior art. The front edge BV of the sheet and the front edge AB of the die of the processing station are lined up. In the case of a subformat sheet 6, a gap results between the back edge BH of the sheet and the back edge EB of the die of the processing station. That is, the braking device 20 does not act on the sheet 6 until it comes to a standstill.

Figure 2B:
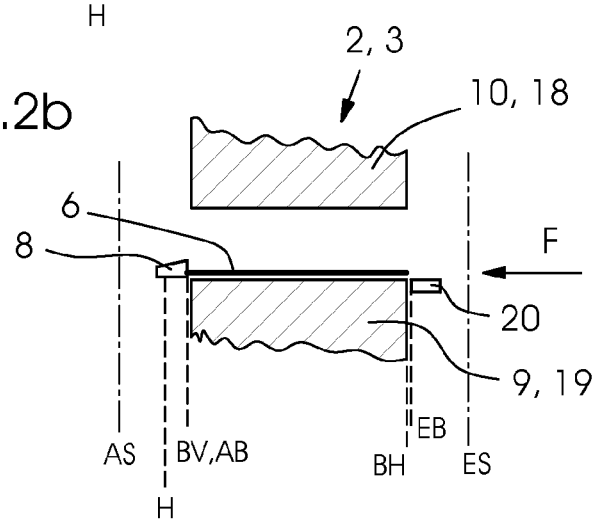
FIG. 2*b* illustrates a representation of a processing station with position of a sheet and a braking device according to a preferred embodiment of the present invention.

FIG. 2*b* shows the stop position H of a sheet 6 in a processing station 2, 3 according to a preferred embodiment of the present invention, where ES is an entry edge of the station and AS is the exit edge of the station. A sheet 6 entering in the sheet transport direction F, as soon as it reaches the braking device 20, is braked by it. Since the sheet 6 is positioned exactly by its back edge BH relative to the back edge EB of the die of the processing station for the processing by lower table 9 and upper table 10 or upper die 18 and lower die 19, the braking device 20 acts on the sheet 6 until it comes to a standstill. The back edge BH of the sheet and the back edge EB of the die of the processing station will lie one directly above the other so that they are aligned and no gap exists therebetween.

Figure 3:
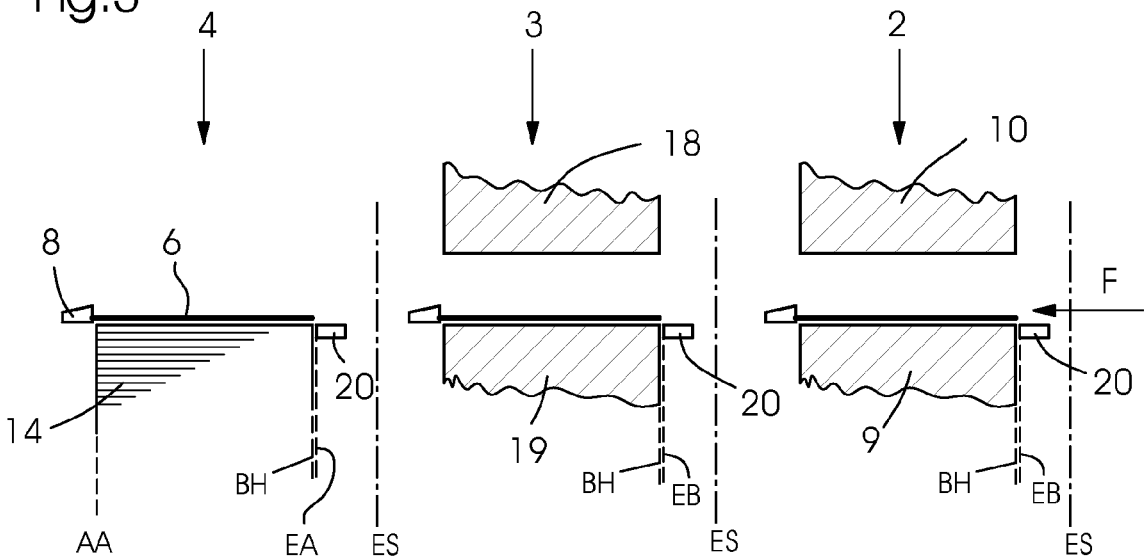
FIG. 3 illustrates a punching station, a processing station and a delivery station showing a position of a sheet and a braking device according to a preferred embodiment of the present invention.
Figure 4:
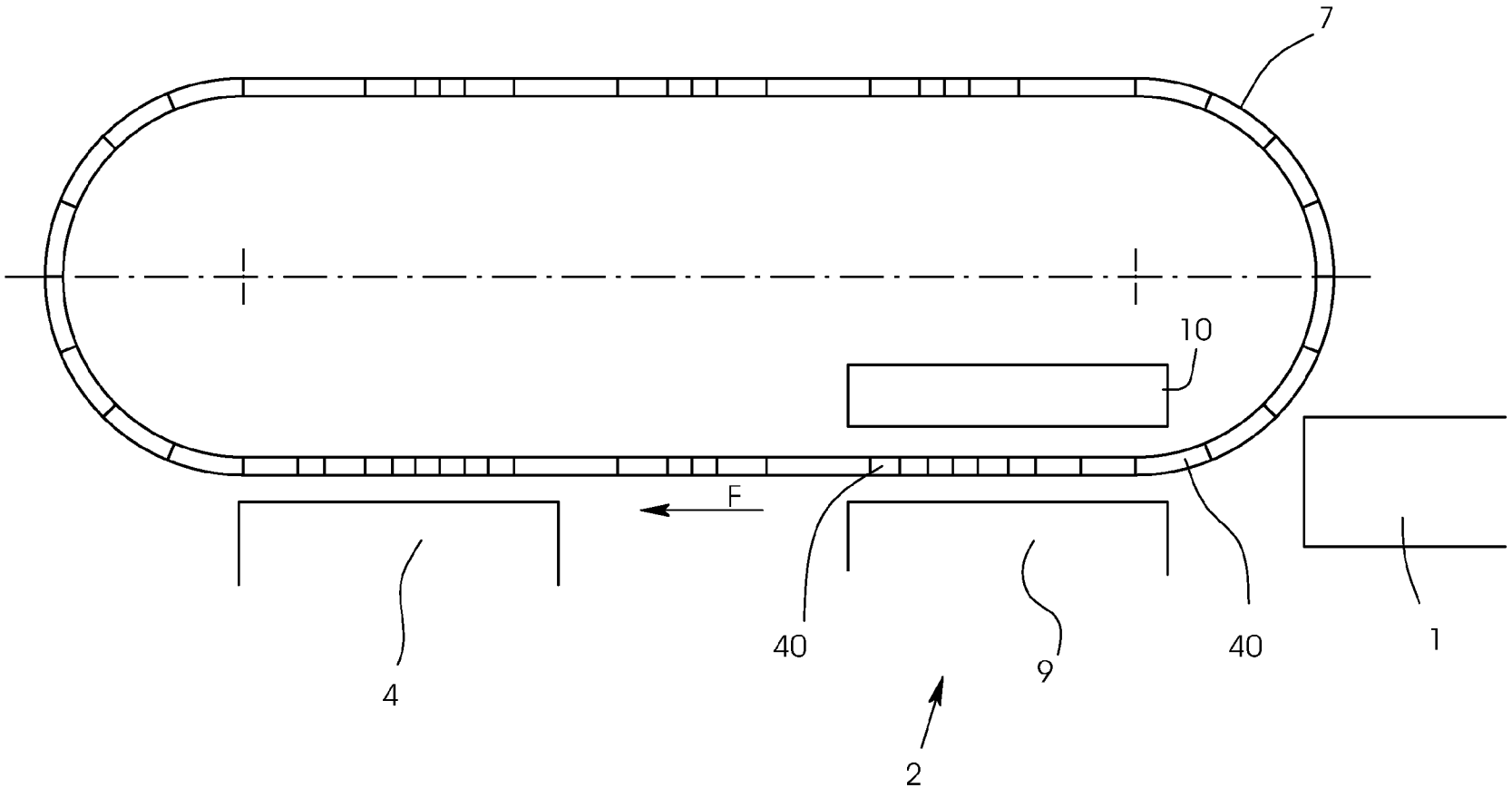
FIG. 4 illustrates a conceptual plan of the punching station including a transport system having a linear drive.

The sheet stop position H of a sheet 6 in its various processing stations 2, 3, and 4 is shown in FIG. 3, in which AA is a front edge of the stack of sheets and EA is a back edge of the stack of sheets. It is clear that the back edge EB of the die of a processing station and the back edge BH of the sheet in the processing stations 2 and 3 each time lie one above the other so that they are aligned and no gap exists therebetween. In the delivery station 4, the back edge EA of the stack and the back edge BH of the sheet again lie one above the other and are aligned so that there is no gap therebetween. This ensures that the braking devices 20 can act in an ideal manner on the particular sheets 6 being braked.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed:

1. A sheet processing machine comprising:

at least one processing station;

at least one delivery unit;

at least one sheet transport system including circulating gripper carts that are driven by individually actuated linear drives;

at least one sheet braking device located between an entry edge of the at least one delivery unit and a rear edge of a stack of sheets; and at least one sheet braking device located between an entry edge of the at least one processing station and a rear edge of at least one processing station tool or die; wherein each respective sheet that is in a stop position in the at least one delivery unit is positioned with respect to a back edge of the respective sheet such that the back edge of the respective sheet and the rear edge of the stack of sheets lie one above the other so as to be aligned with no gap therebetween; and each respective sheet that is in a stop position in the at least one processing station is positioned by the back edge of the respective sheet relative to the rear edge of the at least one processing station tool or die, such that the at least one sheet braking device located between the entry edge of the at least one processing station and the rear edge of the at least one processing station tool or die acts on the respective sheet until the respective sheet comes to a standstill, and such that the back edge of the respective sheet and the rear edge of the at least one processing station tool or die lie one above the other so as to be aligned with no gap therebetween.

2. The sheet processing machine according to claim 1, wherein each of the at least one sheet braking devices includes a sheet brake synchronized with a circulating suction band.

3. The sheet processing machine according to claim 1, wherein each of the at least one sheet braking devices includes a back-edge gripper system including circulating after-grippers to grab the back edge of the sheet.

4. The sheet processing machine according to claim 1, wherein each of the at least one sheet braking devices includes a pneumatic sheet brake with an immobile suction mechanism.

5. The sheet processing machine according to claim 1, wherein each of the at least one sheet braking devices includes braking brushes.

6. The sheet processing machine according to claim 1, wherein each of the at least one sheet braking devices includes a non-synchronized sheet brake having a permanently circulating suction band.

7. The sheet processing machine according to claim 1, wherein the sheet processing machine is a sheet punching and embossing machine.

* * * * *